US005453771A

United States Patent [19]

Waseda et al.

[11] Patent Number: 5,453,771

[45] Date of Patent: Sep. 26, 1995

[54] INK TANK

[75] Inventors: Takayuki Waseda; Takeo Komiyama, both of Tokyo, Japan

[73] Assignee: Citizen Watch Co., Ltd., Tokyo, Japan

[21] Appl. No.: 84,946

[22] Filed: Jul. 2, 1993

[30] Foreign Application Priority Data

Jul. 3, 1992 [JP] Japan ..... 4-198936
Mar. 9, 1993 [JP] Japan ..... 5-015563 U

[51] Int. Cl.[6] ..... B41J 2/175
[52] U.S. Cl. ..... 347/86
[58] Field of Search ..... 346/140 R; 347/85, 347/86, 87, 7; B41J 2/175

[56] References Cited

U.S. PATENT DOCUMENTS 5,155,502 10/1992 Kimura et al. ..... 347/87
5,182,581 1/1993 Kashimura et al. ..... 346/140 R
5,233,369 8/1993 Carlotta et al. ..... 347/87
5,289,212 2/1994 Carlotta ..... 346/140 R

FOREIGN PATENT DOCUMENTS 488829 6/1992 European Pat. Off. ..... B41J/2/175
58-194551 11/1983 Japan .
5-104735 4/1993 Japan ..... B41J/2/175

*Primary Examiner*—Benjamin R. Fuller
*Assistant Examiner*—Alrick Bobb
*Attorney, Agent, or Firm*—Wenderoth, Lind & Ponack

[57] ABSTRACT

An ink cartridge for the ink jet printer has a cartridge housing having a storeroom and an adjustment room therein separated by a bulkhead. The bulkhead extends vertically at the center of the cartridge housing, and has a lower part thereof with a connection opening extending therethrough. The connection opening communicates the storeroom with the adjustment room. The storeroom is airtight except for the connection opening. The adjustment room has an upper part with an air hole communicating the adjustment room with the atmosphere and a lowest part with a feed pocket for feeding ink to a printing head. Fiber-like materials impregnated with ink are filled inside the adjustment room, these materials having a part thereof that extend to the bottom of the storeroom through the connection opening. The fiber-like materials comprise a plurality of felt blocks that have different fiber densities, the felt blocks being arranged so that the closer the felt blocks are to the feed pocket, the greater the fiber density of the felt blocks.

2 Claims, 6 Drawing Sheets

25

LEVEL 21
23
31
28
29
22
24
25
26

INK TANK

BACKGROUND OF THE INVENTION

The present invention relates to the constitution of an ink tank of an ink jet printer, and particularly to the ink storage and ink feeding in an ink tank.

An ink jet printer has had the defect that the performance and quality of printing changes remarkably according to the printing posture, because it uses a liquid ink. Accordingly, a method has been devised which comprises modifying the flow of ink in an ink tank by the capillary action phenomenon and surface tension by putting fibers into the ink tank and correcting the deterioration of the characteristics due to the printing posture.

Hereunder, a conventional method is described according to FIG. 9. Ink 5 is fed to an ink jet printer 1 via an ink fed passage 2 from an ink tank 3. At this time, fibers 4 are put into the ink tank 3 and air is introduced into a space 7 from which ink among the fibers 4 is sucked out through an air intake 6. In this case, if the suction power of the ink jet printer 1 is strong, the ink 5 in the ink tank 3 is sucked to the side of the ink feed passage 2. But if lacking in suction power, however, it is impossible to sufficiently feed ink due to surface tension 20. In addition, if the level of the ink 5 in the ink tank 3 is lower than the nozzle of the ink jet printer 1, the ink jet printer will run out of ink.

Hence, the ink jet printer discloses in Japanese Patent Publication No. 11152/1988 uses ink usefully by collecting ink in the ink tank on the side of the ink feed passage, and at the same time prevents ink from spouting by transferring cells in the ink tank to the side of the space in the ink tank.

The ink jet printer disclosed in Japanese Patent Publication No. 11152/1988 is shown in FIG. 10. An ink jet head 1 is connected with an ink tank 3 via an ink feed passage 2. The internal diameter of the ink tank 3 becomes smaller as it approaches the side of the ink feed passage 2. One kind of fiber 4 is provided in the ink tank 3, and the density of the fiber 4 increases continuously as it approaches the side of the ink feed passage 2, because there is neither a cut-off nor a joint, and ink is collected to one side. Air is introduced into the space 7, from which ink is sucked out from an air intake 6. The air intake 6 is covered with a cover 8 when not used.

According to the conventional constitution, however, it is hard to design a fitting place in fitting an ink tank in a carriage. Ink cannot be introduced into the ink tank, and a sufficient amount of ink cannot be kept in the ink tank, not only because the shape is thin, but also because the fiber is gradually compressed. Consequently, there is a problem in that an ink tank must be large.

Moreover, when only ink is introduced into a vessel, it leaks according to changes of atmospheric temperature and pressure, and hence, in a cartridge-type ink tank to be used in various forms of ink jet printers, various constitutions and methods are employed for the purpose of preventing the leakage of ink and surely bestowing a certain back pressure upon a printing head.

For this, a method has been proposed in which an ink support material (urethane foam) in the vessel is impregnated with ink to maintain ink according to the capillary tube power of the support material, and the back pressure in the vessel is adjusted to an appropriate negative pressure (see e.g. Japanese Patent publication No. 87242/1988).

According to the above constitution, however, the storage volume of ink is reduced by the volume of the ink support material, and besides, ink cannot be usefully used up due to the capillary tube power of the ink support material.

Hence, as shown in FIG. 11, a longitudinally arranged constitution is proposed, in which an ink vessel 33 is divided into two rooms, namely, a main ink storage part 35 for storing ink alone and a secondary ink storage part 34 adjusting overflowed ink (see Japanese Patent publication No. 522/1990). In this constitution, an ink flow path 38 is set between the main ink storage part 35 and the secondary ink storage part 34 and a porous material is installed between a printing head support part 36 for supporting a printing head 39, the ink flow path 38 and the secondary ink storeroom 34.

According to this constitution, however, since the secondary ink storeroom 34, adjusting overflowed ink, does not open to the atmosphere, ink is kept in the secondary ink storeroom without a printing operation when a temperature change occurs. At this time, the diameter of droplets changes according to the occurrence of the difference of water columns between the printing head 39 and the secondary ink storeroom 34 and hence the change of the back pressure upon the printing head, there is a fear of ink leakage from the ink jet nozzle and it is difficult to adjust the back pressure.

Another conventional example of dividing an ink room into two rooms is the one shown in FIG. 12 (see also Japanese Patent Publication No. 99631/1975). In this example, a liquid well 40 is one ink room and is filled with foamed plastic 41 impregnated with ink. A feed pocket 46 for feeding ink into a printing head is at the lowest part. In a liquid fill device 42 provided as another ink room, is an air hole 43 at upper part, the inside is filled with ink 44 and a wick 45 is dipped therein. A tip 47 of the wick passes through an outer wall of the liquid fill device 42 and an opening 48 on an outer wall of the liquid well 40 and comes into contact with the foamed plastic 41 to feed ink.

According to the above constitution, however, there is a problem in ink storage, because the liquid fill device has an air hole. Since the liquid well is filled with the foamed plastic impregnated with ink, ink cannot be usefully used up owing to the capillary tube power. The back pressure increases with the decrease of ink, and thus it is difficult to adjust the back pressure.

OBJECTS AND BRIEF SUMMARY OF THE INVENTION

A first object of the present invention is to provide an ink tank which is capable of solving the above problems, and having a simple shape, storing a sufficient amount of ink and feeding ink stably into an ink jet head.

A second object of the present invention is to provide an ink cartridge for an ink jet printer which makes it possible to increase the amount of ink to be used and bestow a certain back pressure upon a printing head.

The first object of the present invention can be accomplished by filling the ink tank with compressed fiber, the fiber being composed of plural fibers with different densities. The fibers are arranged in such a manner that they are closely filled in the ink tanks, with no space among them and the densities of the fibers increase as they approach the ink feed passage.

The second object of the present invention can be accomplished by dividing the inside of an ink cartridge into two rooms, namely, a storeroom and an adjusting room, by a bulkhead installed in a longitudinal direction, pouring ink into the storeroom until full, filling the adjusting room with a fiber-like material impregnated with ink and letting part of the fiber-like material reach the lower part of the storeroom through a connection opening on the bulkhead. Moreover, it can be accomplished by providing an air hole opening to the atmosphere at the upper part of the adjusting room and a feed pocket opening to the printing head at the lowest part, letting the storeroom be connected with the adjusting room through the connection opening installed at the lower part of the bulkhead and making the remaining part airtight.

DETAILED DESCRIPTION OF THE INVENTION

EXAMPLE 1

Figure 1:
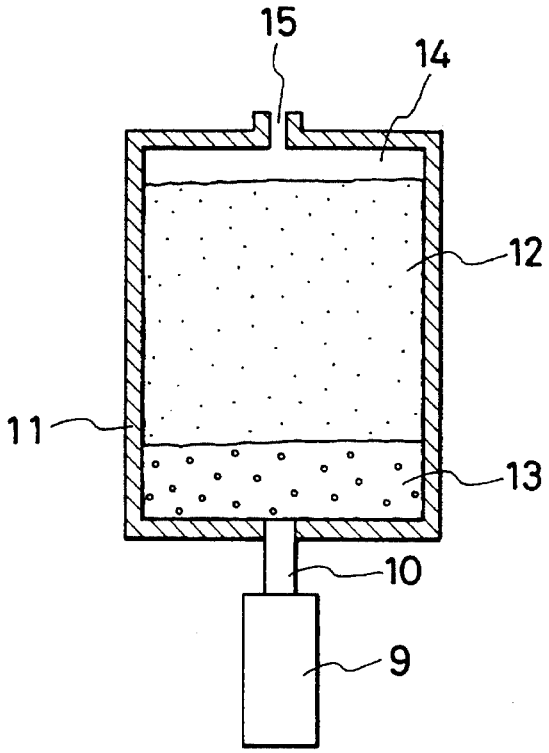
FIG. 1 is an explanatory view showing a first example of the present invention.
Figure 10:
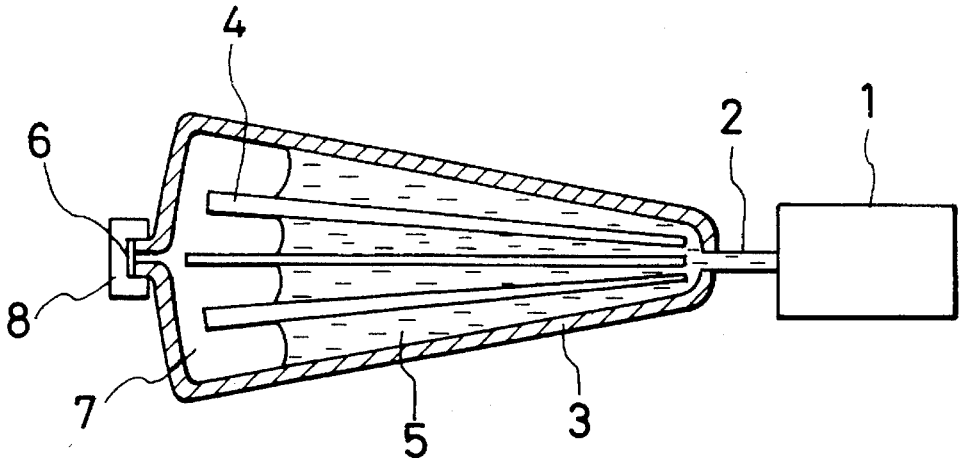
FIG. 10 PRIOR ART
FIG. 10 is an explanatory view showing a conventional ink tank.
Figure 11:
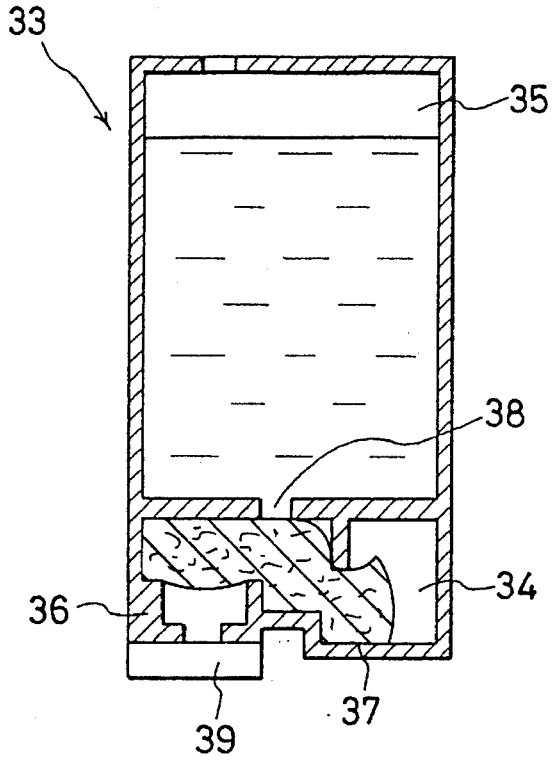
FIG. 11 PRIOR ART
FIG. 11 is a transverse cross sectional view showing a coventional ink cartridge.
Figure 12:
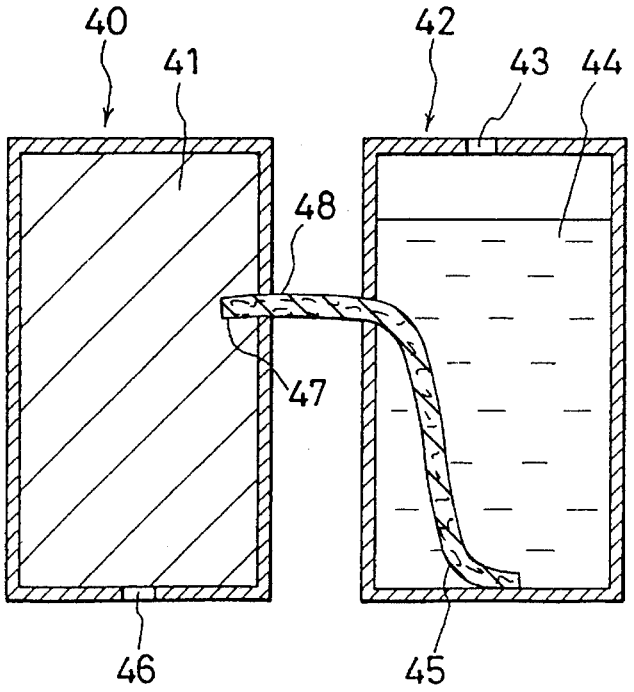
FIG. 12 PRIOR ART
FIG. 12 is a transverse cross sectional view showing a coventional ink cartridge.

Hereunder, an example of the present invention is described according to FIG. 1. An ink jet head 9 is connected to an ink tank 11 through an ink feed passage 10. In the ink tank 3 shown in FIG. 10 as a conventional example, the densities of fibers change according to the change of ink tank form. On the other hand, in the present invention, the ink tank 11 is box-like. In the ink tank 11 are filled plural fibers with different densities over the whole tank, including high-density fibers 13 and low-density fibers 12 in this order relative to the ink feed passage 10 after they are compressed.

The space 14 in the ink tank 11 is an air layer and air is introduced into the space 14 from an air intake 15 after ink is sucked out.

The joints among fibers are pressure-welded in order to prevent the intermission of ink due to the inclusion of air and fibers are filled in closely, with no space among them. The densities of fibers in the ink tank 11 increase toward the side of the ink feed passage 10, and hence ink centers toward the ink feed passage 10.

The high-density fibers 13 have a large number of fibers per unit area and a strong ink absorbing capacity. On the contrary, the low-density fibers 12 have a small number of fibers per unit area and a weak ink absorbing capacity. Therefore, ink in the ink tank in which the high-density fibers 13 and the low-density fibers 12 are filled in this order centers toward the high-density fibers according to the characteristics of capillary tubes. Hence, ink in the ink tank 11 can be usefully used. Since fibers around the ink feed passage 10 are always impregnated with liquid, it is difficult for air to reach the ink feed passage 10 passing through the low-density fibers 12 and the high-density fibers 13. Moreover, air is hard to pass to the ink feed passage 10 through the low-density fibers 12 and the high-density fibers 13 in spite of long-term contact with air.

Figure 2:
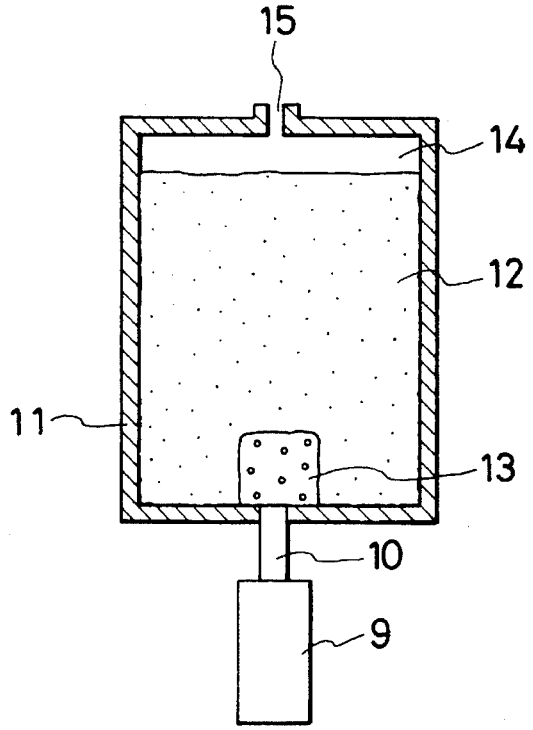
FIG. 2 is an explanatory view showing an ink tank of the first example of the present invention, part of which has been modified from FIG. 1.
Figure 3:
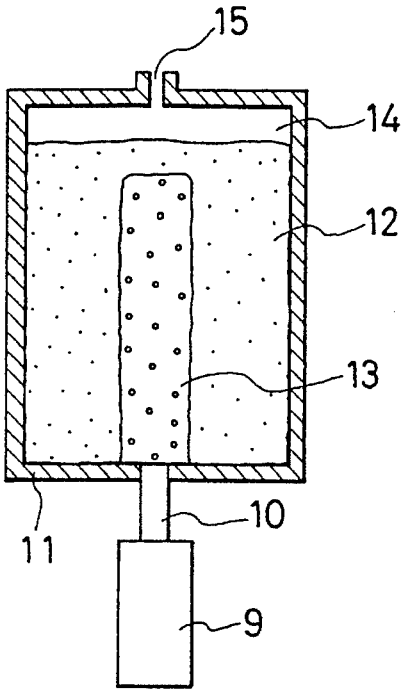
FIG. 3 is an explanatory view showing an ink tank of the first example of the present invention, part of which has been modified from FIG. 1.

FIG. 2 and FIG. 3 are modifications of FIG. 1. Namely, FIG. 2 has high-density fibers 13 only around the ink feed passage 10. According to this constitution, much ink can be maintained in the fibers since many low-density fibers 12 are used. FIG. 3 is an example of extending the high-density fibers 13 shown in FIG. 2 to the upper part of the ink tank to make it easy to absorb ink from the low-density fibers 12.

Fiber materials for the fibers to be filled in the ink tank can be hair, nylon and polyester. When they are filled in the ink tank, they are compressed to felt and filled in the ink tank. In additon, it is effective to subject the fiber materials to a water absorbing treatment. By utilizing felt, it becomes possible to select the densities of the fibers relatively freely according to the kinds of fiber materials and the adjustment of the compression of the fibers and it is easy to make the fibers suited for the shape of the ink tank.

EXAMPLE 2

Figure 4:
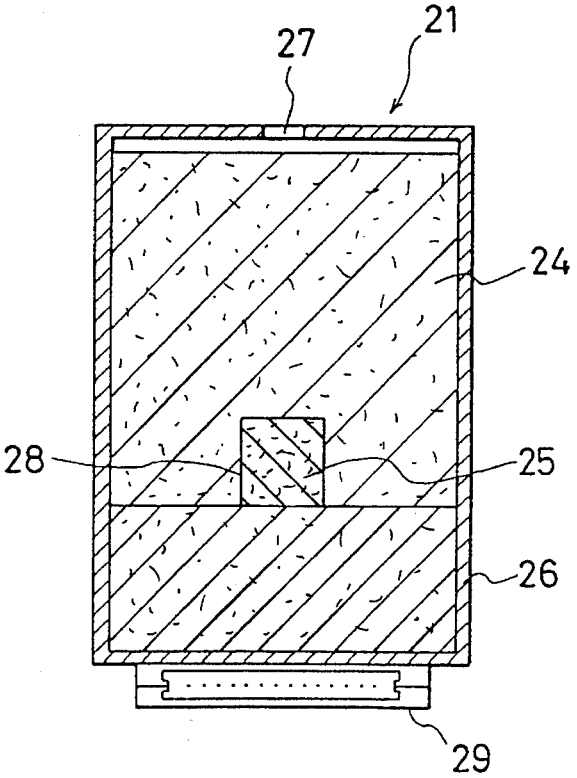
FIG. 4 is a transverse cross section showing the internal structure of a second example, in which the ink tank of the present invention is applied to a cartridge.
Figure 5:
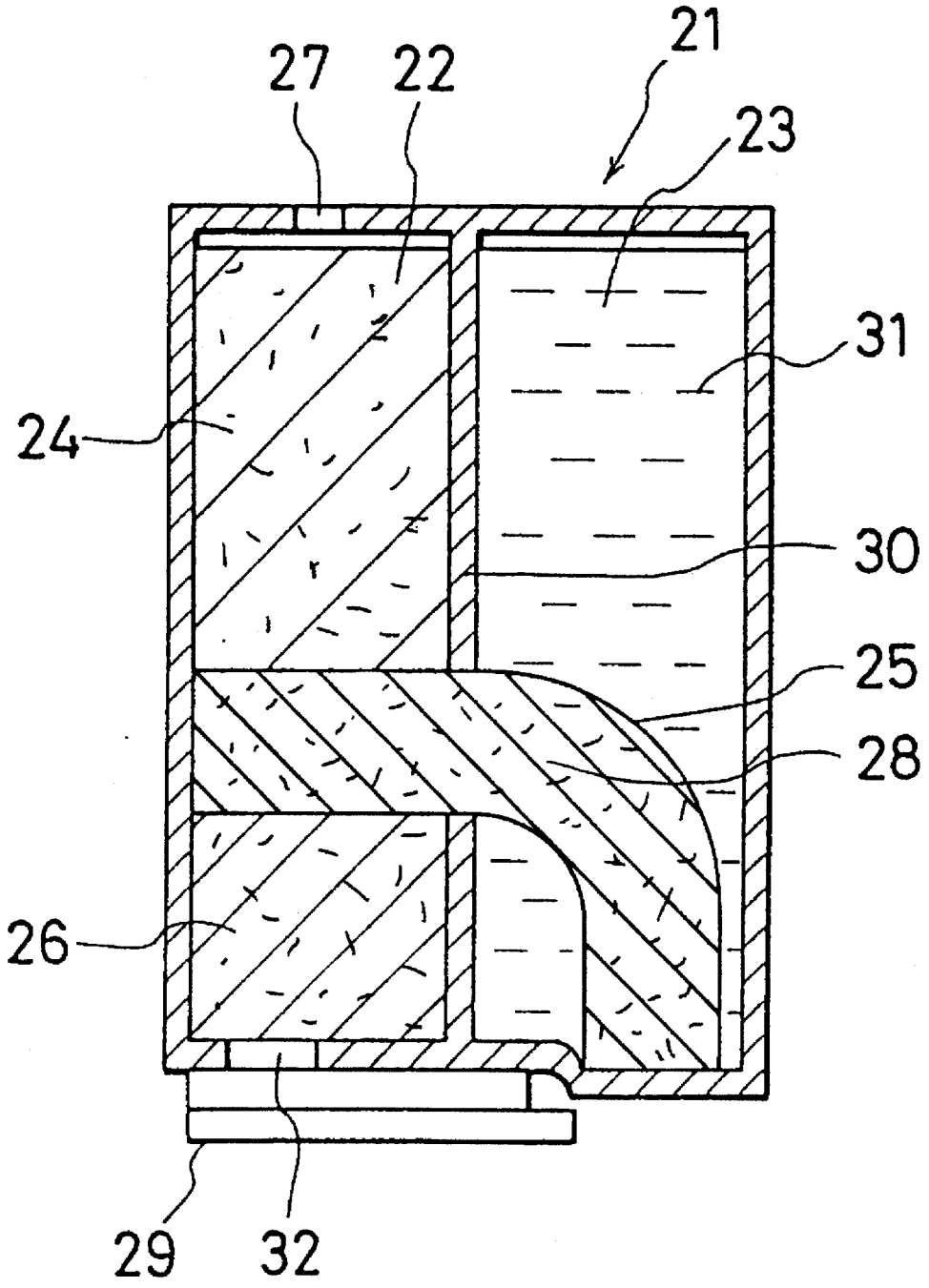
FIG. 5 is a transverse cross sectional view of the example of FIG. 4.

FIG. 4 and FIG. 5 are transverse cross sections of in two directions crossing with each other, showing the internal structure of a cartridge-type ink tank. The inside of a housing of an ink cartridge 21 is divided into two rooms, namely, an adjustment room 22 and a storeroom 23, by a bulkhead 30 installed longitudinally. There exists an air hole 27 opening to the atmosphere at the upper part of the adjustment room 22 and a feed pocket 32 feeding ink into a printing head at the lowest part. The storeroom 23 opens to the adjustment room 22 through a connection opening 28 installed at the lower part of the bulkhead 30, and the remaining part is airtight. Ink 31 is filled in the storeroom 23 and fiber-like materials impregnated with ink are filled in the adjustment room 22. Some parts of the fiber-like materials reach the bottom of the storeroom 23 through the connection opening 28.

The fiber-like materials filled in the adjustment room 22 are composed of plural felt blocks 24, 25 and 26 provided with different densities. As they near the feed pocket 23 opening to the printing head 29, felt blocks with higher fiber densities are provided. Moreover, by arranging part of the wall surface of the storeroom 23 of a transparent material, it becomes possible to optically the amount of remaining ink.

Figure 8:
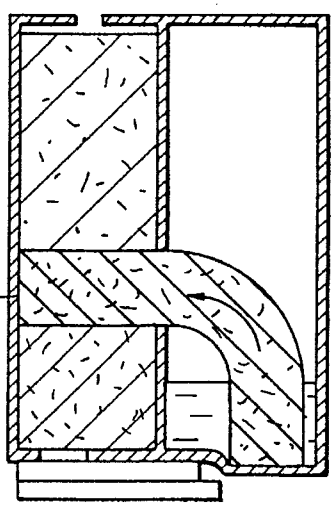
FIG. 8 is a transverse cross sectional view of an ink cartridge according to the present invention in use.
Figure 7:
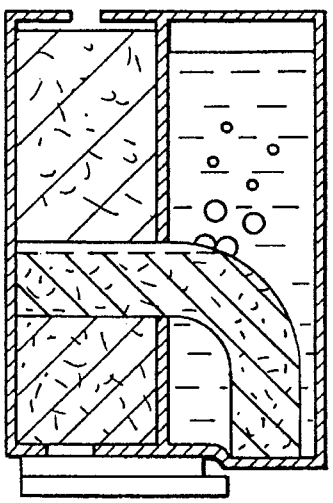
FIG. 7 is a transverse cross sectional view of an ink cartridge according to the present invention in use.
Figure 6:
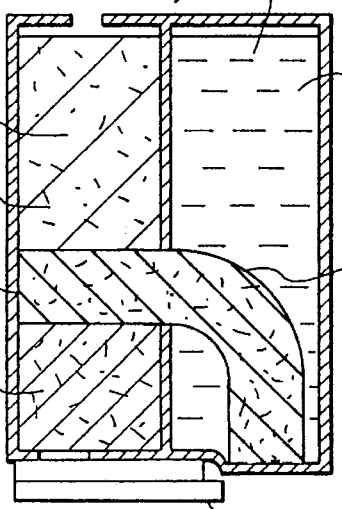
FIG. 6 is a transverse cross sectional view of an initial state of an ink cartridge according to the present invention.
Figure 9:
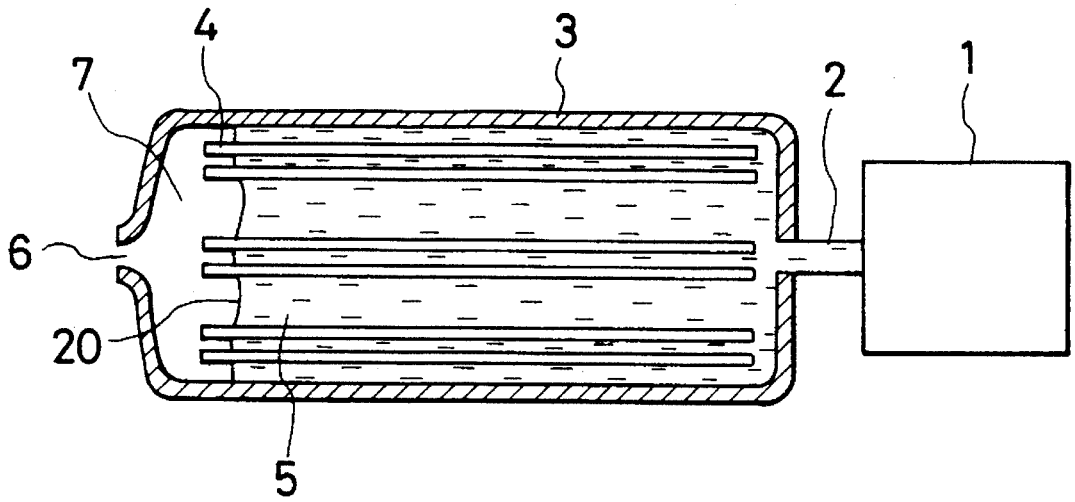
FIG. 9 PRIOR ART
FIG. 9 is an explanatory view showing a conventional ink tank.

Next, the operation of the present device is described according to FIGS. 6–8. FIG. 6 shows the same as in FIG. 5 as an initial state. FIGS. 7 and 8 are transverse cross sections of cartridges showing the consumption of ink. Ink 31 is filled in the storeroom 23. Felt 24, felt 25 and felt 26 in the adjustment room 22 are impregnated with ink. When the level of the ink contained in the felt in the adjustment room 22 is above the connection opening 28, the storeroom 23 remains in the same state, as the connection opening 28 is covered with ink and in an airtight state, and hence the ink does not flow into the adjustment room 22. When printing is conducted by means of the printing head 29, ink in the ink cartridge 21 is consumed from ink contained in the felt 24 of the adjustment room 22. In this case, by increasing the fiber density of the felt 24, felt 25 and felt 26 in this order, the flow of ink is further effective since ink is induced in a direction of the feed pocket according to the difference in capillary attractions power.

Moreover, when the level of ink contained in the felt of the adjustment room 22 becomes below the upper rim of the connection opening 28, as shown in FIG. 7, by the performance of a printing operation, air is introduced into the storeroom 23 from the upper rim of the connection opening 28, and at the same time, the ink 31 of the storeroom 23 passes through the felt 25 by the amount of air introduced into the storeroom 23 and is fed into the adjustment room 22. As a result, this operation is performed repeatedly, as long as the ink 31 of the storeroom 23 is above the connection opening 28 and the level of the felt 25 and the felt 26 of the adjustment room 22 does not change. Thus, the back pressure in the ink cartridge 21 can be kept at a specific amount during the above operation.

In addition, when air inflation occurs due to the change of circumstances during the feeding of ink from the storeroom 23, the ink 31 of the storeroom 23 flows into the adjustment room 22 and is absorbed in the felt 24. When the internal pressure becomes normal again, the ink of the felt 24 returns to the storeroom 23, but all ink does not return to the storeroom 23 because of ink maintaining capacity of the felt 24, and ink is again fed from the adjustment room 22 in the state of FIG. 6.

According to the further performance of a printing operation, when the level of the ink 31 of the storeroom 23 becomes below the connection opening 28 as shown in FIG. 8, the ink 31 is sucked up by the felt 25 inserted into the storeroom 23 from the adjustment room 22 and is fed into the adjustment room 22 until all ink 31 of the storeroom 23 is sucked up. After that, ink is consumed from the felt 25 and the felt 26, in this order.

Here, if the connection opening 28 is located at the lowest part of the bulkhead 30, the ink 31 flows to the bottom of the adjustment room 22, and the back pressure increases when air inflation occurs according to the change of circumstances with little ink 31 remaining in the storeroom 23. Besides, when the remaining amount of ink is detected, the liquid surface changes and hence it is impossible to recognize it exactly.

Hence, it is desirable to install the connection opening 28 above the lower part of the bulkhead 30, as in the examples. By installing it as above, the inflated air of the storeroom 23 passes through the connection opening 28 and the felt 24 of the adjustment room 22 and is discharged out from the air hole 27 even if air inflation occurs due to the change of circumstances, as long as the liquid surface is below the connection opening 28. Thus, neither the liquid surface of the ink 31 nor the back pressure changes. Moreover, since the liquid surface is stable, the remaining amount of ink in the storeroom 23 can be detected exactly and optically if the wall surface of the storeroom 23 is composed of a transparent material.

Further, according to the above constitution, even if the storeroom 23 becomes empty, there is no fear of the running-out of ink immediately after an empty storeroom warning, since ink still remains in the felt 25 and the felt 26 of the adjustment room 22.

After all ink in the ink cartridge 21 is used up, the ink cartridge 21 is removed from the printing head 29 and replaced with a new cartridge to again perform printing.

According to the present invention, by compressing plural fibers with different densities and filling them in the ink tank and increasing the densities of the filled fibers the nearer they are to the ink feed passage, a smooth transfer of ink becomes possible without intermission of a flow of ink, and ink centers toward the side of the ink feed passage. Hence, ink can always be stably fed into the ink jet head.

As described above, in the ink cartridge of the present device, it is possible to keep a sufficient holding volume of ink according to a storeroom in which only ink is filled to capacity and an adjustment room in which fiber materials impregnated with ink are filled, and at the same time, it is possible to delete the remaining, wasteful ink and maintain the back pressure properly according to the cooperative operation of the adjustment room and the storeroom. In addition, the inducement of ink flow becomes further ensured by employing plural felt blocks with different fiber densities as fiber materials. Moreover, it is certain and easy to optically detect the remaining amount of ink.

We claim:

1. An ink cartridge for an ink jet printer, comprising:

a cartridge housing having a storeroom and an adjustment room therein separated by a bulkhead, said bulkhead having a lower part thereof that has a connection opening extending therethrough and communicating said storeroom with said adjustment room, said storeroom having a bottom and being airtight except for said connection opening, and said adjustment room having an upper part with an air hole and a lower part with a feed pocket; and fiber-like materials filled inside said adjustment room, said fiber-like materials having a part thereof extending from said adjustment room, through said connection opening and to said bottom of said storeroom;

wherein said fiber-like materials comprise a plurality of felt blocks having different fiber densities, and wherein said felt blocks are arranged so that the closer said felt blocks are to said feed pocket, the greater the fiber density of said felt blocks; and wherein said fiber-like materials comprise three of said plurality of felt blocks, including an upper block, a lower block and a middle block, and wherein said middle block comprises said part of said fiber-like materials extending through said connection opening into and to said bottom of said storeroom.

2. The ink cartridge of claim 1, wherein said storeroom further comprises a portion thereof made of a transparent material so that an amount of ink remaining in said storeroom can be optically detected from the exterior thereof.

* * * * *